United States Patent [19]

Agius

[11] Patent Number: 4,600,191

[45] Date of Patent: Jul. 15, 1986

[54] BOWLERS AID

[76] Inventor: Lewis Agius, 7730 Claymore Ct. E., Canton, Mich. 48187

[21] Appl. No.: 676,771

[22] Filed: Nov. 29, 1984

Related U.S. Application Data

[63] Continuation-in-part of Ser. No. 560,230, Dec. 12, 1983, abandoned.

[51] Int. Cl.[4] ..... A63B 71/04

[52] U.S. Cl. ..... 273/54 B; 273/189 A

[58] Field of Search ..... 273/54 B, 189 A

[56] References Cited

U.S. PATENT DOCUMENTS 2,468,580 4/1949 Weis et al. ..... 273/189 A
2,809,042 10/1957 Wasley ..... 273/189 A X
3,106,718 10/1963 Raab ..... 273/189 A X
3,942,525 3/1976 Dragan ..... 273/54 B
3,975,015 8/1976 Owens et al. ..... 273/54 B

*Primary Examiner*—Anton O. Oechsle
*Attorney, Agent, or Firm*—Charles W. Chandler

[57] ABSTRACT

A bowler's aid comprising a plastic, relatively stiff shell forming a segment of a cylinder mounted on the inside of the user's arm adjacent his elbow. The shell has a sufficient stiffness to lock the bowler's elbow in a straight position during the back swing and delivery until he releases the bowling ball. The shell permits him to bend his elbow, prior to beginning his back swing, by applying a pressure with his other hand on the shell's midsection toward his elbow.

4 Claims, 4 Drawing Figures

BOWLERS AID

CROSS REFERENCE TO RELATED APPLICATION

This invention is a Continuation-In-Part of my copending application Ser. No. 560,230 filed Dec. 12, 1983 abandoned.

BACKGROUND OF THE INVENTION

This invention is related to a device for locking a bowler's arm in a fully extended position as he completes his delivery, and more particularly to a shell adapted to fit on the inside of the user's upper arm and forearm and capable of being bent with the user's elbow prior to initiating his back swing by applying his free hand on the shell's midsection.

Bowlers achieve a more efficient and accurate ball release if their arm is in a straight delivery position. There are a variety of bowling aids known in the prior art which lock the arm in a straight position and some, under certain circumstances, permit him to bend his arm prior to delivery.

Some such devices are illustrated in U.S. Pat. No. 3,698,389, which issued Oct. 17, 1972 to Arthur Guedel; U.S. Pat. No. 3,975,015 which issued Aug. 17, 1976 to Paul J. Owens, et al; and U.S. Pat. No. 4,367,872 which issued Jan. 11, 1983 to Herbert Langston. Some bowlers desire to bend their arm to raise the ball prior to the back swing. Those prior art devices which accommodate elbow bending usually employ relatively complicated mechanical devices.

Other arm restraining devices disclosed for golfers are to be found in U.S. Pat. No. 2,468,580 which issued to A. H. Weis et al on Apr. 26, 1949; U.S. Pat. No. 2,809,042 which issued to R. E. Wasley, Oct. 8, 1957; and U.S. Pat. No. 3,106,718 which issued to J. H. Raab, Oct. 15, 1963. Each of these provide only a resilient resistance to arm bending. They do not lock the arm in a fully extended position.

SUMMARY OF THE INVENTION

The broad purpose of the present invention is to provide an improved means for locking a bowler's arm in a fully extended position. The preferred embodiment of the invention, which will be described in greater detail, employs a plastic shell forming a section of a cylinder mounted on the inside of the bowler's arm between his biceps and his forearm. The shell is mounted in a sleeve with a pair of straps that embrace the biceps and forearm.

When the bowler's arm is straight, the shell has a sufficient stiffness to lock his arm in a straight position unless the user applies a predetermined pressure on the midsection of the shell with his other hand so as to bend the shell and the elbow together. When the bowler begins his back swing and straightens out his arm, the shell snaps to a straight position thereby locking the bowler's arm in a fully extended position. The shell cannot be bent by an effort applied solely by the locked arm.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
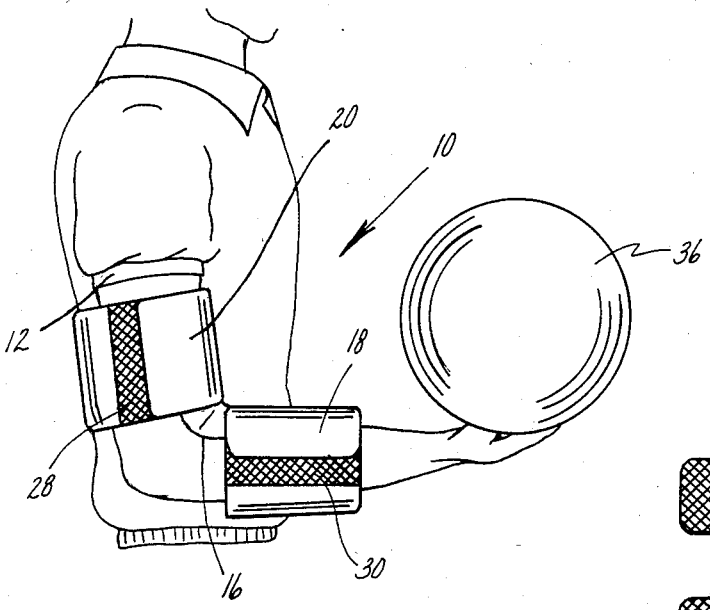
FIG. 1 illustrates the preferred device mounted on the user's arm with his elbow in a bent position.
Figure 2:
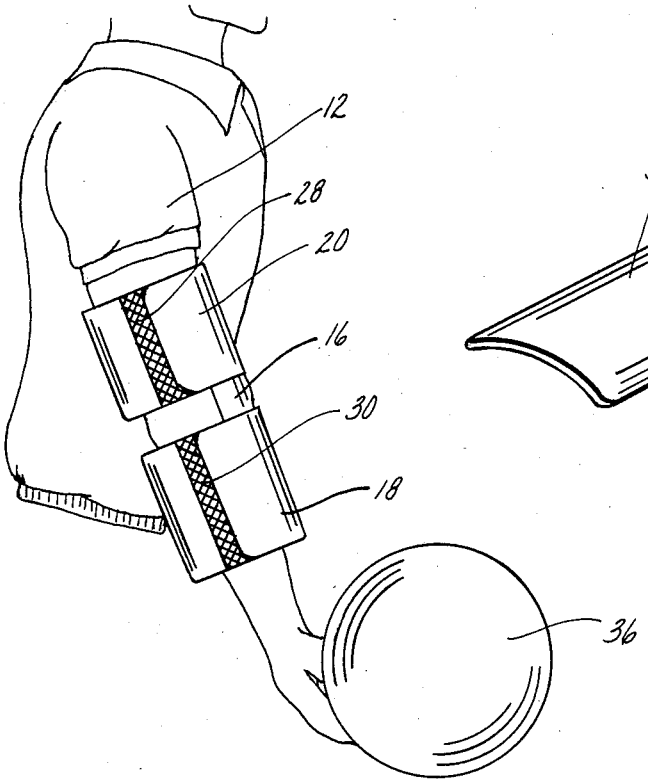
FIG. 2 is a view showing the device locking the user's arm in a straight position.

Referring to the drawing, a preferred bowler's aid 10 is illustrated in FIGS. 1 and 2, mounted on user's arm 12. The bowler's aid includes a fabric securing means 14 having an elongated sleeve 16. The sleeve has a length of about 10 inches.

A pair of fabric bands 18 and 20 extend from opposite ends of the sleeve in a common direction. A foam liner 22 is attached to one side of the sleeve and extends about two-thirds of the length of the bands. Fabric Velcro hook means 24 are attached to the end of band 18 and similar hook means 26 are attached to end of band 20. A pair of fabric Velcro loop means 28 and 30 are attached to the opposite side of the bands to cooperate with the hook means to form a releasable fastening means of the type well known to those skilled in the art. The two bands are adapted to embrace the user's biceps and forearm. The hook and fastener means permit the bands to accommodate the diameter of the user's arm.

Figure 3:
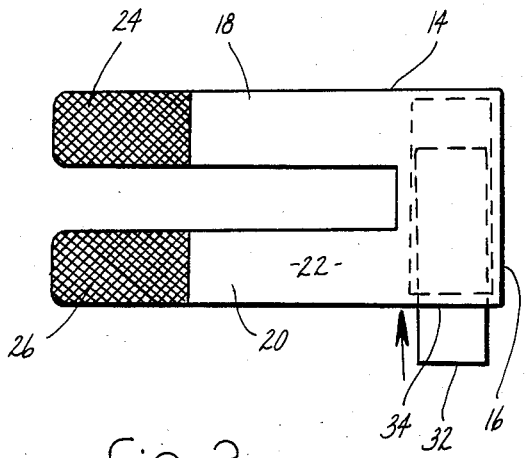
FIG. 3 is a view of the sleeve in its unwrapped position.
Figure 4:
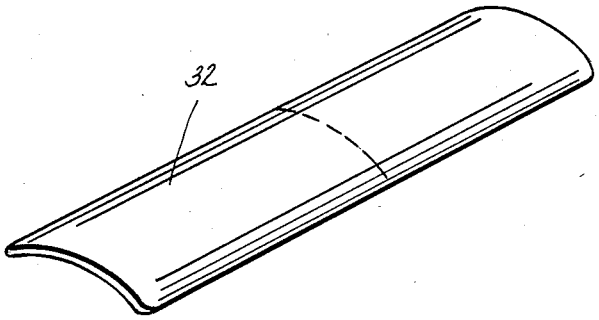
FIG. 4 is a view of the shell separated from the sleeve.

Referring to FIGS. 3 and 4, a plastic locking shell 32 is received through opening 34 of the sleeve. The shell has a length accommodating the length of the sleeve and forms a segment of a cylinder. The shell is about 3/32 seconds of an inch thick. The shell is relatively stiff, however, when mounted in the sleeve on the bowler's arm, as illustrated in FIG. 2, with the concave side of the shell adjacent the user's arm, the bowler cannot bend his arm to the position illustrated in FIG. 1 unless he applies a bending force with his other hand to the convex side of the midsection of the shell, at the location shown in a dashed line in FIG. 4. When bent by the opposite hand, the shell permits the user to bend his elbow with the shell and to raise the ball to the position of FIG. 1. When the user begins his backswing so that the arm assumes a straight position, illustrated in FIG. 2, the shell snaps to its locking position, thereby locking the user's elbow in a straight position as he completes his delivery swing.

The preferred device is relatively simple and eliminates the mechanical devices necessary in the prior art.

Having described my invention I claim:

1. A device for locking a bowler's elbow against bending, comprising:

an elongated shell forming a segment of a cylinder having a concave side and a convex side, the concave side thereof being adapted to be mounted adjacent the biceps and inner forearm of the user in an unbent position, the shell having a sufficient stiffness to prevent any bending thereof by the user's arm on which the shell is mounted from said unbent position, the longitudinal midsection of the shell being bendable such that the convex side of one end of the shell is movable toward the convex side of the opposite end thereof, but only in response to means applied to the convex side of the midsection of the shell for moving the midsection in a direction normal to the longitudinal axis of the shell; and securing means for mounting the shell in close fitting relationship on the user's arm adjacent the biceps and inner forearm thereof.

2. A device as defined in claim 1, in which the securing means includes an elongated fabric sleeve for receiving the shell;

a pair of elongated bands connected to opposite ends of the sleeve for embracing the biceps and forearm respectively of the user; and fastener means for connecting the ends of the bands to the sleeve.

3. A device as described in claim 1, in which the fastener means comprises a fabric hook and loop fastener means.

4. A device as defined in claim 1, including foam liner means carried on the sleeve so as to be disposed adjacent the user's arm.

* * * * *